US009207569B2

(12) United States Patent
Otani

(10) Patent No.: US 9,207,569 B2
(45) Date of Patent: Dec. 8, 2015

(54) IMAGE FORMING APPARATUS, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventor: Atsushi Otani, Moriya (JP)

(73) Assignee: CANON KABUSHIKI KAISHA (JP)

( * ) Notice: Subject to any disclaimer, the term of this patent is extended or adjusted under 35 U.S.C. 154(b) by 237 days.

(21) Appl. No.: 13/799,420

(22) Filed: Mar. 13, 2013

(65) Prior Publication Data

US 2013/0266329 A1 Oct. 10, 2013

(30) Foreign Application Priority Data

Apr. 5, 2012 (JP) ..... 2012-086478

(51) Int. Cl.
*G03G 15/08* (2006.01)

(52) U.S. Cl.
CPC ..... *G03G 15/0824* (2013.01); *G03G 15/086* (2013.01); *G03G 15/0849* (2013.01)

(58) Field of Classification Search
CPC ..... G03G 15/0831; G03G 15/0856; G03G 15/086; G03G 2215/0888
USPC ..... 399/27
See application file for complete search history.

(56) References Cited

FOREIGN PATENT DOCUMENTS

| | | | |
|---|---|---|---|
| JP | 2001215782 A | * | 8/2001 |
| JP | 2002-132038 A | | 5/2002 |
| JP | 2003323036 A | * | 11/2003 |
| JP | 2006301189 A | * | 11/2006 |
| JP | 2006301264 A | * | 11/2006 |

OTHER PUBLICATIONS

Yamauchi (JP 2003-323036 A), Nov. 2003, JPO Computer Translation.*

* cited by examiner

*Primary Examiner* — Erika J Villaluna
(74) *Attorney, Agent, or Firm* — Rossi, Kimms & McDowell LLP

(57) ABSTRACT

An image forming apparatus that is capable of reducing an effect of variation of specific inductive capacity of toner due to environmental variation with a small detection error when the remaining toner amount is detected. The image forming apparatus forms an image with an electrophotographic system. A container unit stores toner. A toner detection unit has sensor modules that are arranged at positions where the toner is stagnated in the container unit, and that show different electrostatic capacities with respect to the same toner thickness. An electrostatic capacity detection unit detects the electrostatic capacities of the sensor modules. A determination unit determines a remaining toner amount in the container unit based on the electrostatic capacities of the sensor modules that are detected by the electrostatic capacity detection unit.

21 Claims, 13 Drawing Sheets

IMAGE FORMING APPARATUS, CONTROL METHOD THEREFOR, AND STORAGE MEDIUM STORING CONTROL PROGRAM THEREFOR

BACKGROUND OF THE INVENTION

1. Field of the Invention

The present invention relates to a technique of detecting a remaining toner amount in an image forming apparatus like a copying machine or a printer using an electrophotographic system.

2. Description of the Related Art

There is a known image forming apparatus using the electrophotographic system that is provided with a toner remaining amount sensor for detecting a remaining toner amount or existence of toner. There are many methods of detecting the remaining toner amount. One of them is known as an electrostatic capacity method by which the remaining toner amount is detected as electrostatic capacity between electrodes.

The remaining toner amount sensor of the electrostatic capacity method detects the toner remaining amount on the principle that the electrostatic capacity between the electrodes varies with the amount of toner (dielectrics) between the electrodes. Accordingly, when specific inductive capacity $\in t$ of the toner changes, the different electrostatic capacities are detected for the same remaining toner amount. For example, the specific inductive capacity $\in t$ of toner changes with humidity and temperature. Since the specific inductive capacity $\in t$ increases as the moisture content of toner increases, the toner amount that is determined as little under the dry condition may be determined as enough under the absorbed moisture condition.

In view of such a problem, Japanese Laid-Open Patent Publication (Kokai) No. 2002-132038 (JP 2002-132038A) suggests a method of correcting the detected remaining toner amount by reflecting measured environmental conditions, such as temperature and humidity, that become factors of varying the specific inductive capacity $\in t$ of toner as a method of raising the detection accuracy of the remaining toner amount by the remaining toner amount sensor.

However, the measured environmental condition is not necessarily coincident with the condition of toner. Accordingly, when the measured environmental condition is different from the condition of toner, the remaining toner amount detected by the remaining toner amount sensor in the electrostatic capacity method has an error.

SUMMARY OF THE INVENTION

The present invention provides an image forming apparatus, a control method therefor, and a storage medium storing a control program therefor, which are capable of reducing an effect of variation of specific inductive capacity of toner due to environmental variation with a small detection error when the remaining toner amount is detected.

Accordingly, a first aspect of the present invention provides an image forming apparatus that forms an image with an electrophotographic system comprising a container unit configured to store toner, a toner detection unit configured to have a plurality of sensor modules that are arranged at positions where the toner is stagnated in the container unit, and that show different electrostatic capacities with respect to the same toner thickness, an electrostatic capacity detection unit configured to detect the electrostatic capacities of the sensor modules, and a determination unit configured to determine a remaining toner amount in the container unit based on the electrostatic capacities of the sensor modules that are detected by the electrostatic capacity detection unit.

Accordingly, a second aspect of the present invention provides a control method for an image forming apparatus that forms an image with an electrophotographic system, and that has a container unit that stores toner, a toner detection unit that has a plurality of sensor modules that are arranged at positions where the toner is stagnated in the container unit and that show different electrostatic capacities with respect to the same toner thickness, the control method comprising an electrostatic capacity detection step of detecting the electrostatic capacities of the sensor modules, and a determination step of determining a remaining toner amount in the container unit based on the electrostatic capacities of the sensor modules that are detected in the electrostatic capacity detection step.

Accordingly, a third aspect of the present invention provides a non-transitory computer-readable storage medium storing a control program causing a computer to execute the control method of the second aspect.

The present invention can reduce an effect of variation of specific inductive capacity of toner due to environmental variation when the remaining toner amount is detected. Accordingly, the remaining toner amount can be detected with a small detection error.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
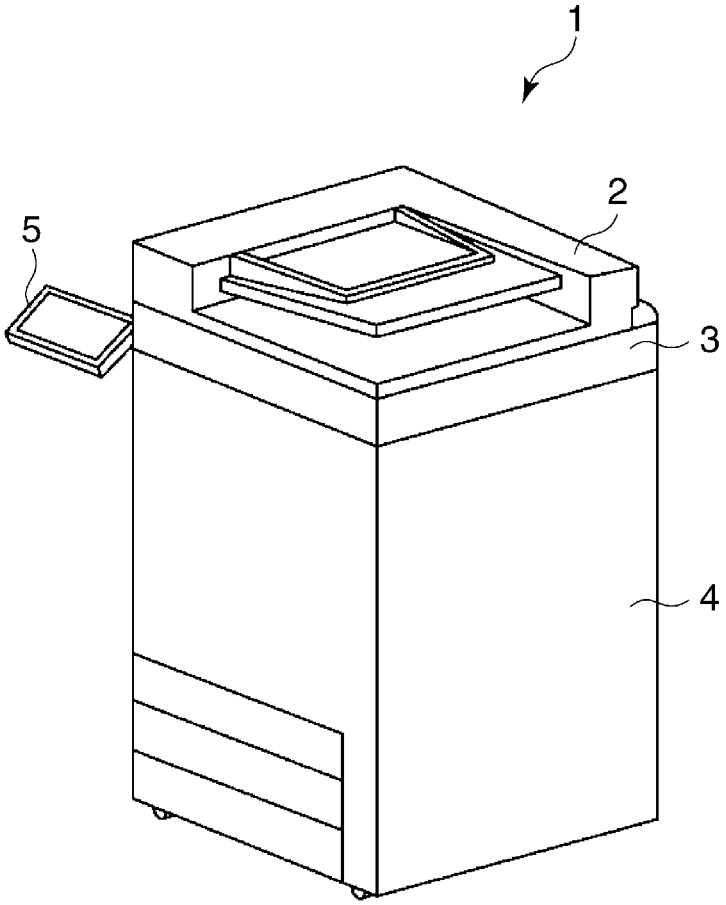
FIG. 1 is a general perspective view of an image forming apparatus according to an embodiment of the present invention.

FIG. 1 is a general perspective view of an image forming apparatus 1 according to the embodiment of the present invention. The image forming apparatus 1 consists of an automatic original feeding device 2, an image reading section 3, an image forming unit 4, and an operation unit 5 in general.

The automatic original feeding device 2 conveys an original onto a contact glass automatically. The image reading section 3 reads the original which the automatic original feeding device 2 conveys, and outputs image data. The image forming unit 4 forms an image on a sheet, such as a recording paper, according to image data that is outputted from the automatic original feeding device 2 or that is inputted from an external apparatus connected via a network. The operation unit 5 has a GUI (graphical user interface) that allows a user to perform various operations, and a loudspeaker that notifies the user of a reception of an operation and an abnormal condition of the system.

Figure 2:
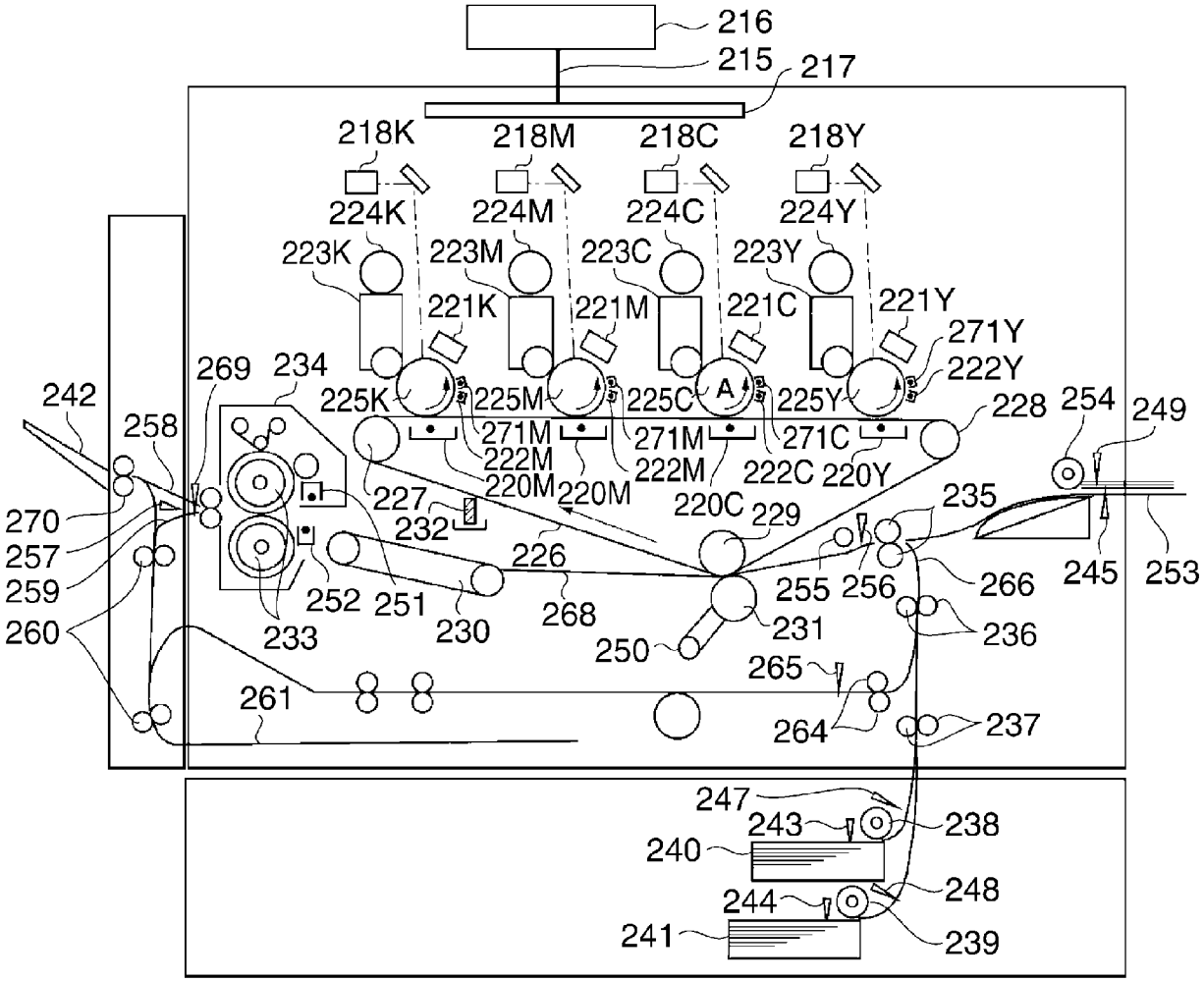
FIG. 2 is a sectional view showing a configuration of an image forming unit with which the image forming apparatus shown in FIG. 1 is provided.

FIG. 2 is a sectional view showing a configuration of the image forming unit 4. The image forming unit 4 operates in the electrophotographic system. In FIG. 2, alphabets Y, M, C, and K added to ends of reference numerals represent configurations corresponding to the toners of yellow, magenta, cyan, and black, respectively. In the following description, a common configuration for all the toners is indicated by a reference numeral without adding the alphabet Y, M, C, or K, and an individual configuration for each toner is indicated by a reference numeral with the alphabet Y, M, C, or K.

A controller 216 controls communication ports (not shown), such as USB and LAN, and the image reading section 3 of the image forming apparatus 1, and generates data that is transmitted to the image forming unit 4. Moreover, the controller 216 performs transmission of image data and communication of control information to an engine control unit 217 through a printer control I/F 215. The engine control unit 217 performs overall sequence control of the image forming unit 4 according to the image data and the control information received from the controller 216.

A photosensitive drum 225 that is a photoconductor as an image bearing member on which a full color electrostatic image is formed rotates in a direction of an arrow A by a motor (not shown). Around the photosensitive drum 225, a primary charging device 221, an exposure device 218, a development device 223, a transfer device 220, a cleaning device 222, and a discharging device 271 are arranged.

The development device 223K is used for monochrome development by developing a latent image on the photosensitive drum 225K with K toner supplied from a toner bottle 224K. The development devices 223Y, 223M, and 223C are used for full color development by developing latent images on the photosensitive drums 225Y, 225M, and 225C with Y toner, M toner, and C toner supplied from toner bottles 224Y, 224M, and 224C, respectively. The toner images of four colors developed on the surfaces of the photosensitive drums 225 are multi-transferred to a transfer belt 226 by the transfer devices 220 so that the toner images are overlapped.

The transfer belt 226 is looped over rollers 227, 228, and 229 while keeping tension. The roller 227 is combined with a driving source (not shown), and functions as a driving roller that drives the transfer belt 226. The roller 228 functions as a tension roller that adjusts the tension of the transfer belt 226. Further, the roller 229 functions as a backup roller of a transfer roller as a secondary transfer device 231. A transfer roller swinging unit 250 is a drive unit that makes the secondary transfer device 231 contact with or move away from the transfer belt 226. A cleaner blade 232 is arranged downstream of the secondary transfer device 231 along the transfer belt 226. The cleaner blade 232 scrapes the remaining toner off the transfer belt 226.

Sheets are stored in cassettes 240 and 241 or are mounted on a manual feeding unit 253. The cassettes 240 and 241, and the manual feeding unit 253 have sheet detection sensors 243, 244, and 245 for detecting the existence of a sheet, respectively. Moreover, the cassettes 240 and 241, and the manual feeding unit 253 have feeding sensors 247, 248, and 249 for detecting a poor pick up of a sheet, respectively.

When an image formation starts, a sheet stored in the cassette 240 (or 241) is picked up by a pickup roller 238 (or 239) one-by-one and is conveyed to a feeding roller pair 235 through longitudinal pass roller pairs 237 and 236, and a feed path 266. Moreover, a sheet mounted on the manual feeding unit 253 is picked up by a pickup roller 254 one-by-one and is conveyed to the feeding roller pair 235. The feeding roller pair 235 conveys a sheet to a registration roller 255. At this time, a registration sensor 256, which is arranged near the registration roller 255 at the upstream side of the registration roller 255, detects the passage of the sheet.

When predetermined time elapses after the registration sensor 256 detects the passage of the sheet, the conveyance operation is interrupted. Thereby, the sheet bumps against the stopped registration roller 255, and stops. In that case, the front end of sheet is fixed so that the sheet end becomes vertical to the conveyance path, and a skew of the sheet to the conveyance path is corrected. Next, the sheet is fed to a contact point between a secondary transfer device 231 and the transfer belt 226 by the registration roller 255. It should be noted that the registration roller 255 is combined with a driving source (not shown), and a driving force of the driving source is transferred to the registration roller 255 via a clutch (not shown) to rotate.

A toner image is formed in synchronization with such a sheet conveyance. That is, the surface of the photosensitive drum 225 is uniformly charged with predetermined minus electrification potential by impressing voltage to the primary charging device 221. Next, the exposure device 218 that consists of a laser scanner unit exposes an image region on the electrified photosensitive drum 225 so as to become predetermined exposure potential and to form a latent image. The exposure device 218 forms the latent image corresponding to the image on the photosensitive drum 225 by turning on and off a laser beam based on the image data sent from the controller 216 through the printer control I/F 215.

A developing bias predetermined for each color is applied to a developing roller of the development device 223 beforehand, and the latent image on the photosensitive drum 225 is developed by the toner so as to be visualized as a toner image when the image passes the position of the developing roller. The toner image is transferred to the transfer belt 226 by the transfer device 220. At this time, the toner remained on the photosensitive drum 225 is removed and recovered by the cleaning device 222. Moreover, the photosensitive drum 225 is uniformly discharged up to about 0V (zero voltage) by the discharging device 271, and gets ready for the following image-formation cycle.

When the toner image transferred to the transfer belt 226 is transferred to the sheet, the secondary transfer device 231 is held by the transfer roller swinging unit 250 so as to contact with the transfer belt 226. In this state, the toner image is transferred onto the conveyed sheet by the secondary transfer device 231 at the contact point between the transfer belt 226 and the secondary transfer device 231. The sheet to which the toner image was transferred passes a post-registration conveyance path 268, and is conveyed through a fixing conveying belt 230 to the fixing device 234.

In the fixing device 234, the toner image is charged by pre-fixing electrostatic chargers 251 and 252 in order to compensate the adsorptive power of toner and to prevent image deterioration, and then, the toner image is fixed by heat with a fixing roller 233. When the print process is finished, the sheet after the heat fixing process for the toner image is ejected to an ejection tray 242 by an ejection roller 270 through the conveyance path that is switched to an ejection path 258 by an ejection flapper 257.

It should be noted that the image forming unit 4 can continuously feed the sheets from the cassettes 240 and 241, and the manual feeding unit 253. In this case, the sheets are fed from the cassettes 240 and 241, and the manual feeding unit 253 at the intervals so as not to overlap the sheets in consideration of the length of the preceding sheet. As mentioned above, the sheet is supplied to the secondary transfer device 231 by starting the registration roller 255, and the registration roller 255 temporally stops when the sheet passed. This is for correcting a position of the following sheet in the same manner as the preceding sheet.

Moreover, the image forming unit 4 is provided with a mechanism that returns the sheet to the secondary transfer device 231 for forming an image onto the other side after forming the image onto one side of the sheet as mentioned above. This mechanism is provided with a sensor 269, the ejection flapper 257, a reverse side path 259, a reversal roller 260, a double-sided inversion path 261, a paper-re-feeding roller 264, and a paper-re-feeding sensor 265, etc., and a sheet is reversed and conveyed with these elements to the feed path 266 again.

Figure 3:
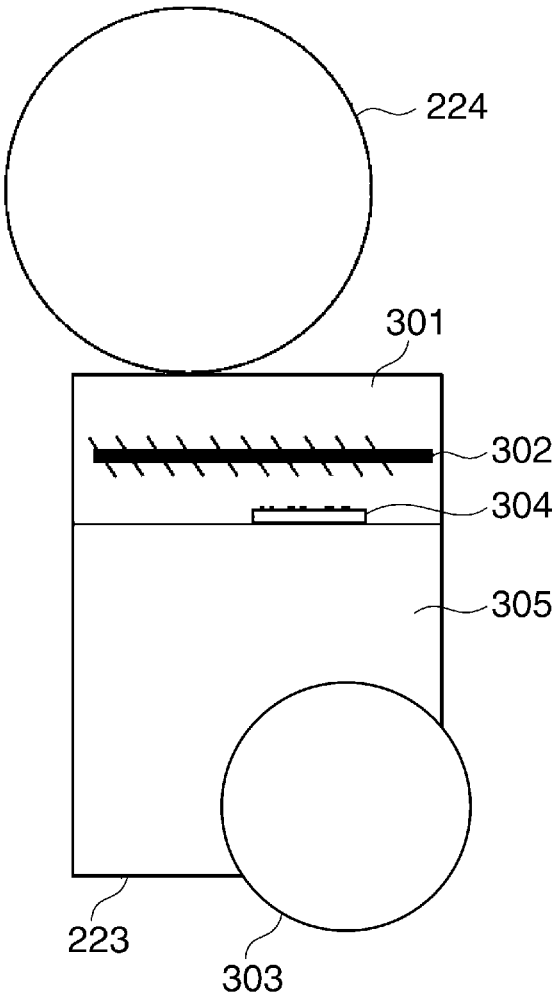
FIG. 3 is a sectional view showing a detailed configuration of a developing unit with which the image forming unit shown in FIG. 2 is provided.

FIG. 3 is a sectional view showing the detailed configuration of the development device 223. Since the fundamental configuration is common for each of colors Y, M, C, and K, the elements in FIG. 3 are designated by the reference numerals without the alphabets Y, M, C, and K. The development device 223 can be divided mainly into a buffer unit (a container unit) 301 and a developing unit 305.

After the toner that fills a toner bottle 224 goes into the buffer unit 301 that stores toner, the toner is conveyed by a rotating mixing screw 302 to the developing unit 305. A toner sensor 304 for detecting the amount of toner that stagnates in the buffer unit 301 is arranged in the buffer unit 301. The toner conveyed to the developing unit 305 is supplied to the photosensitive drum 225 through a development cylinder 303, and the latent image on the photosensitive drum 225 is visualized.

Figure 4:
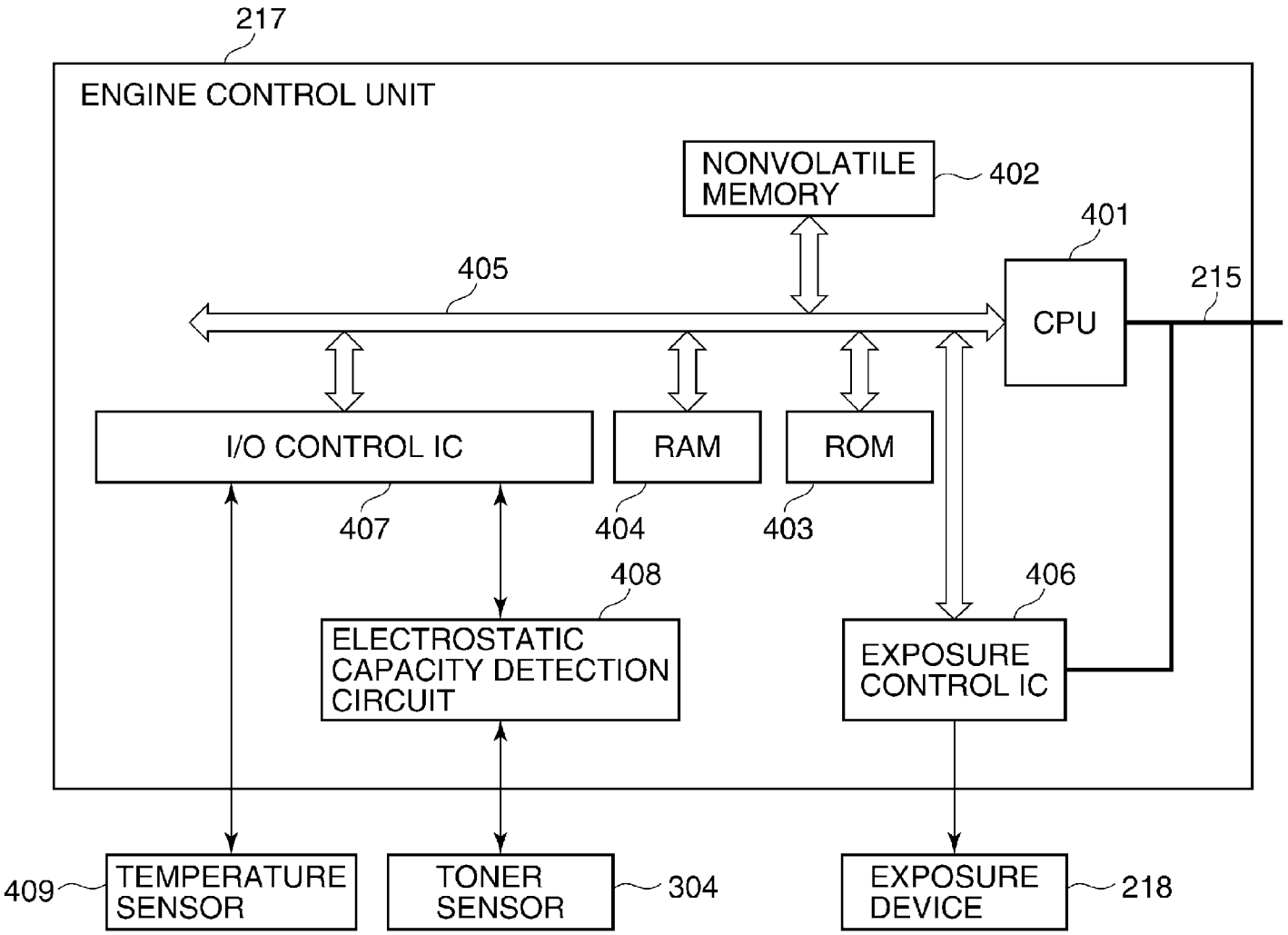
FIG. 4 is a block diagram showing a configuration of an engine control unit with which the image forming unit shown in FIG. 2 is provided.

FIG. 4 is a block diagram schematically showing a configuration of the engine control unit 217. A CPU 401 is connected with an external device (not shown) through a bus 405. Moreover, the CPU 401 is connected with a nonvolatile memory 402, a ROM 403, a RAM 404, an exposure control IC 406, and an I/O control IC 407 through the bus 405.

The ROM 403 is a program memory that stores a program for the CPU 401. The RAM 404 functions as a work memory for the CPU 401. When receiving an instruction sent from the controller 216 through the printer control I/F 215, the CPU 401 controls the entire system of the image forming unit 4 by developing and running the predetermined program stored in the ROM 403 to the work area of the RAM 404.

The nonvolatile memory 402 stores the data that needs to keep among the control information about the engine control unit 217, when the image forming apparatus 1 is turned off. The exposure control IC 406 controls the exposure device 218 according to the command from the CPU 401.

The I/O control IC 407 is equipped with many input-output ports connected to various devices, controls actuators like a motor according to commands from the CPU 401, and receives the information inputted from various kinds of sensors. An electrostatic capacity detection circuit 408 connected to the I/O control IC 407 detects electrostatic capacities of a first sensor module 510, a second sensor module 511, and a third sensor module 512 with which the toner sensor 304 is provided (they will be described later with reference to FIG. 5). Moreover, a temperature sensor 409 connected to the I/O control IC 407 measures internal temperature of the image forming unit 4. The CPU 401 controls the toner sensor 304, the electrostatic capacity detection circuit 408, and the temperature sensor 409 through the I/O control IC 407, and acquires electrostatic capacity data and thermal data.

Figure 5A:
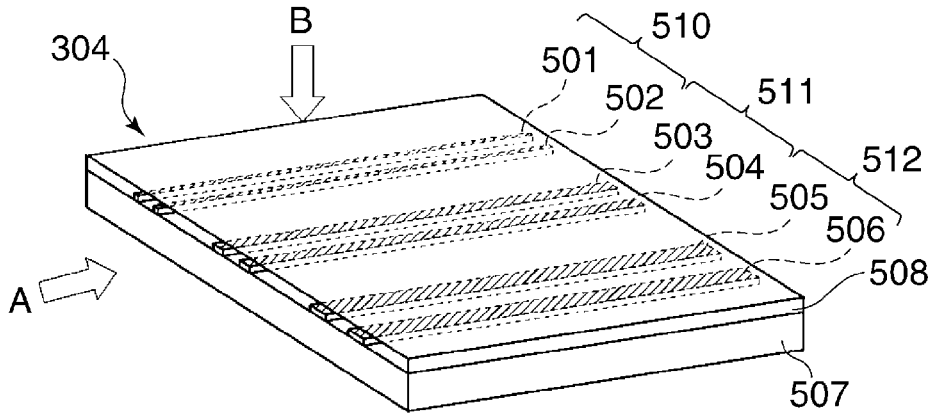
FIG. 5A, FIG. 5B, and FIG. 5C are a perspective view, a side view, and a plan view showing a configuration of toner sensor shown in FIG. 3, respectively.
Figure 5B:
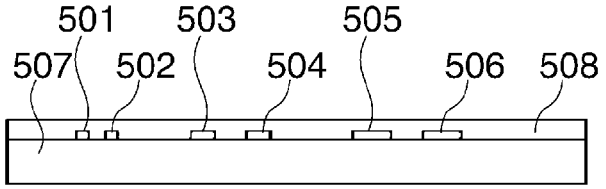
Figure 5C:
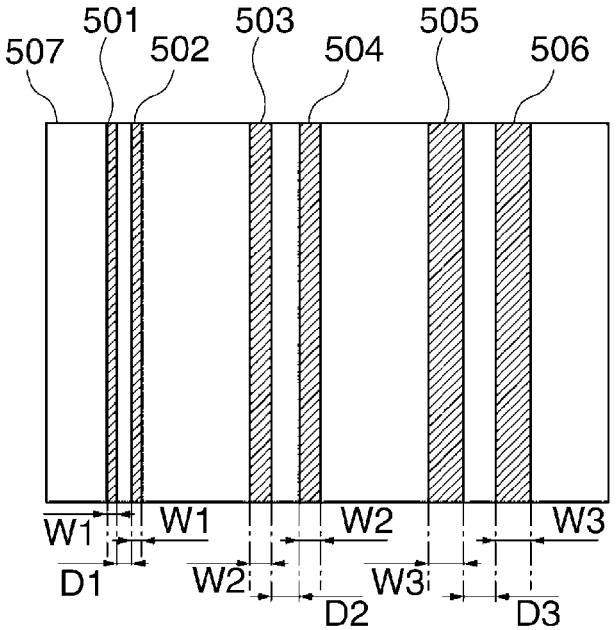
Figure 6:
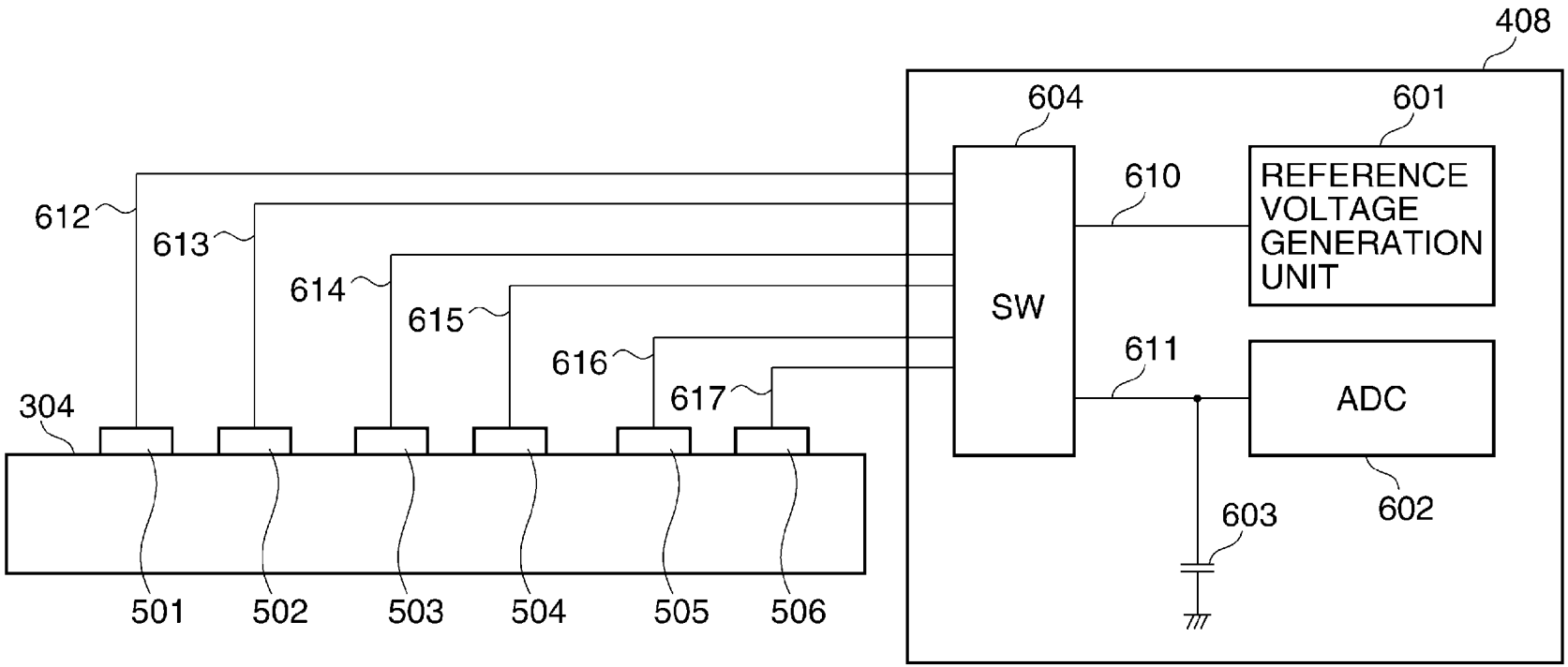
FIG. 6 is a view showing an example of a circuit configuration of an electrostatic capacity detection circuit shown in FIG. 4 and a connection configuration between the toner sensor and the electrostatic capacity detection circuit.

FIG. 5A, FIG. 5B, and FIG. 5C are views showing the configuration of the toner sensor 304. FIG. 5A is a perspective view, FIG. 5B is a side view seen in a direction of arrow A in FIG. 5A, and FIG. 5C is a plan view (top plan) seen in a direction of arrow B in FIG. 5A. FIG. 6 is a view showing the configuration of the electrostatic capacity detection circuit 408, and the connection configuration of the electrostatic capacity detection circuit 408 and the toner sensor 304.

As shown in FIG. 5A and FIG. 5B, electrodes 501 through 506 that are conductors of predetermined line widths are formed on a substrate 507 at predetermined spacings. A pair of electrodes 501 and 502 comprise the first sensor module 510, a pair of electrodes 503 and 504 comprise the second sensor module 511, and a pair of electrodes 505 and 506 comprise the third sensor module 512, respectively. Each of these first, second, and third sensor modules 510, 511, and 512 detects the electrostatic capacity between the pair of electrodes. It should be noted that the surface of the substrate 507 is covered with a protection sheet 508 for protecting the electrodes 501 through 506.

The electrostatic capacities of the first sensor module 510, the second sensor module 511, and the third sensor module 512 increase as the thickness of toner on the surface of the toner sensor 304 increases. Accordingly, the toner thickness on the surface of the toner sensor 304 can be detected based on variations of the electrostatic capacities of the first sensor module 510, the second sensor module 511, and the third sensor module 512.

As shown in FIG. 5C, the first sensor module 510 has the electrodes 501 and 502 of the line width W1 that are formed at the conductor spacing D1 in this embodiment. Moreover, the second sensor module 511 has the electrodes 503 and 504 of the line width W2 that are formed at the conductor spacing D2. Furthermore, the third sensor module 512 has the electrodes 505 and 506 of the line width W3 that are formed at the conductor spacing D3.

The different line widths and the different conductor spacings are given to the electrodes of the first, second, and third sensor modules 510, 511, and 512 so that the sensor modules show different capacitance laws with respect to the same variation of toner amount (thickness). Details thereof will be described below. It should be noted that the line widths and the conductor spacings of the electrodes are set so as to satisfy relations of W1<W2<W3 and D1<D2<D3 in this embodiment. However, the configurations of the sensor modules are not limited to the above mentioned configurations. One of the line width and the conductor spacing may be changed in order to acquire different capacitance laws for the respective sensor modules.

Next, variations in the electrostatic capacities of the first, second, and third sensor modules 510, 511, and 512 to a variation of the toner amount (thickness) on the surface of the toner sensor 304 will be described with reference to FIG. 7. Then, the detail of FIG. 6 is described anew.

Figure 7A:
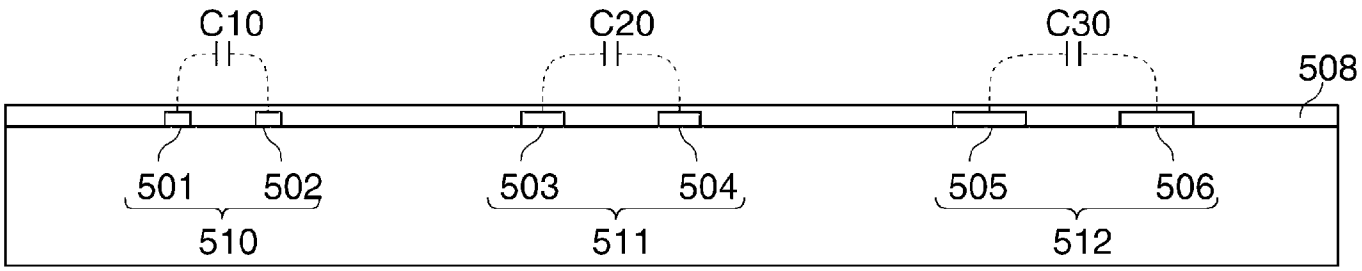
FIG. 7A, FIG. 7B, and FIG. 7C are views schematically showing relations between the toner thickness on the surface of the toner sensor shown in FIG. 5 and the electrostatic capacities detected.
Figure 7B:
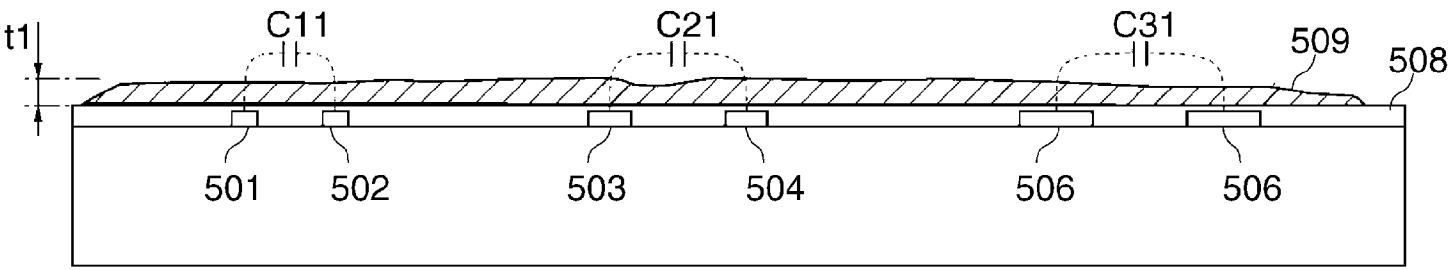
Figure 7C:
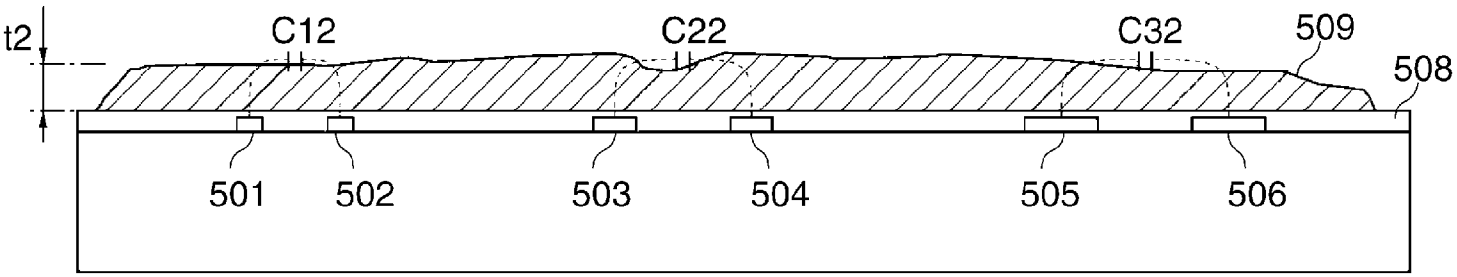

FIG. 7A, FIG. 7B, and FIG. 7C are views schematically showing relations between the thickness of a toner layer 509 (referred to as "toner thickness" in the following description) on the sensor surface of the toner sensor 304 and the electrostatic capacities detected.

FIG. 7A shows the state where toner does not exist on the sensor surface of the toner sensor 304. In this state, the electrostatic capacities of the first sensor module 510, the second sensor module 511, and the third sensor module 512 are dependent on specific inductive capacity ∈b of the substrate 507 and specific inductive capacity ∈s of the protection sheet 508. In addition, since the inter electrode distance between adjacent sensor modules is set to be larger than the spacing of the pair of electrodes in each sensor module, the electrostatic capacity of each sensor module shall not be affected by the electrodes of other sensor modules.

The substrate 507 and the protection sheet 508 are made from material with small hygroscopic property. Accordingly, the specific inductive capacities ∈b and ∈s are considered as constants, respectively. The electrostatic capacities of the first sensor module 510, the second sensor module 511, and the third sensor module 512 in the state shown in FIG. 7A are detected under an initial state of the image forming apparatus 1, and are stored in the nonvolatile memory 402 as standard electrostatic capacities. Here, the standard electrostatic capacity of the first sensor module 510 shall be "C10", the standard electrostatic capacity of the second sensor module 511 shall be "C", and the standard electrostatic capacity of the third sensor module 512 shall be "C30".

FIG. 7B shows the state where the toner layer 509 accumulated on the sensor surface of the toner sensor 304 by thickness t1. In this state, since there is the toner layer 509 that is dielectric with larger specific inductive capacity than 1.0 near the electrodes of the first, second, and third sensor modules 510, 511, and 512, the electrostatic capacities of the first, second, and third sensor modules 510, 511, and 512 become larger as compared with the state shown in FIG. 7A. Electrostatic capacities of the first, second, and third sensor modules 510, 511, and 512 in the state shown in FIG. 7B shall be "C11", "C21", and "C31", respectively.

FIG. 7C shows the state where the toner layer 509 accumulated on the sensor surface of the toner sensor 304 by thickness t2. Since the thickness t2 is larger than the thickness t1, the electrostatic capacities of the first, second, and third sensor modules 510, 511, and 512 become larger as compared with the state shown in FIG. 7B. Electrostatic capacities of the first, second, and third sensor modules 510, 511, and 512 in the state shown in FIG. 7C shall be "C12", "C22", and "C32", respectively.

The following formulas 1 through 3 hold among the standard electrostatic capacities C10, C20, and C30 shown in FIG. 7A, the electrostatic capacities C11, C21, and C31 shown in FIG. 7B, and the electrostatic capacities C12, C22, and C32 shown in FIG. 7C.

$$C10<C11<C12 \quad \text{[Formula 1]}$$

$$C20<C21<C22 \quad \text{[Formula 2]}$$

$$C30<C31<C32 \quad \text{[Formula 3]}$$

That is, the electrostatic capacities of the first, second, and third sensor modules 510, 511, and 512 increase with the toner thickness accumulated on the sensor surface of the toner sensor 304. Moreover, since the respective sensor modules have the different configurations, the first, second, and third sensor modules 510, 511, and 512 show the different capacitance laws (the different properties in detection of electrostatic capacity), even if toner thickness is the same.

The electrostatic capacity detection circuit 408 connected with the toner sensor 304 is enough to detect the variations in the electrostatic capacities of the first, second, and third sensor modules 510, 511, and 512, and the circuit configuration of the electrostatic capacity detection circuit 408 is not limited to that shown in FIG. 6.

The electrostatic capacity detection circuit 408 consists of a reference voltage generation unit 601, an ADC 602 that converts an analog signal into a digital value, a standard capacitor 603 that generates reference voltage, and a switch 604. The reference voltage generation unit 601 and the ADC 602 are connected to the switch 604 via a pair of signal lines 610 and 611.

A pair of signal lines 612 and 613 are connected to the pair of electrodes 501 and 502 of the first sensor module 510, and a pair of signal lines 614 and 615 are connected to the pair of electrodes 503 and 504 of the second sensor module 511. Moreover, a pair of signal lines 616 and 617 are connected to the pair of electrodes 505 and 506 of the third sensor module 512. These three pairs of signal lines 612 and 613, 614 and 615, 616 and 617 are connected to the switch 604.

The switch 604 selects the connection target of the pair of signal lines 610 and 611 from among the pair of signal lines 612 and 613, the pair of signal lines 614 and 615, and the pair of signal lines 616 and 617. For example, when the electrostatic capacity of the first sensor module 510 is detected, the switch 604 connects the pair of signal lines 610 and 611 to the pair of signal lines 612 and 613. Thereby, a voltage divider that connects two capacitors in series between the reference voltage generation unit 601 and GND is configured. Then, the ratio of the electrostatic capacities of the standard capacitor 603 and the first sensor module 510 can be acquired by measuring the electric potential of the middle point of the voltage divider. That is, when the generated voltage of the reference voltage generation unit 601 shall be "V1", the electrostatic capacity of the standard capacitor 603 shall be "C1", and the input voltage of the ADC 602 shall be "V2", the relation of the following formula 4 holds.

$$C1/Ca=(V1-V2)/V2 \quad \text{[Formula 4]}$$

Since the values of "Ca" and "V1" are known, the value of "C1" can be acquired by measuring the value of "V2". The output value of the ADC 602 is outputted to the CPU 401 through the I/O control IC 407, and the CPU 401 calculates the electrostatic capacity of the first sensor module 510 based on the output value from the ADC 602. Similarly, the CPU 401 controls the I/O control IC 407 to change the connection target of the switch 604, and calculates the electrostatic capacities of the second sensor module 511 and the third sensor module 512.

Figure 8:
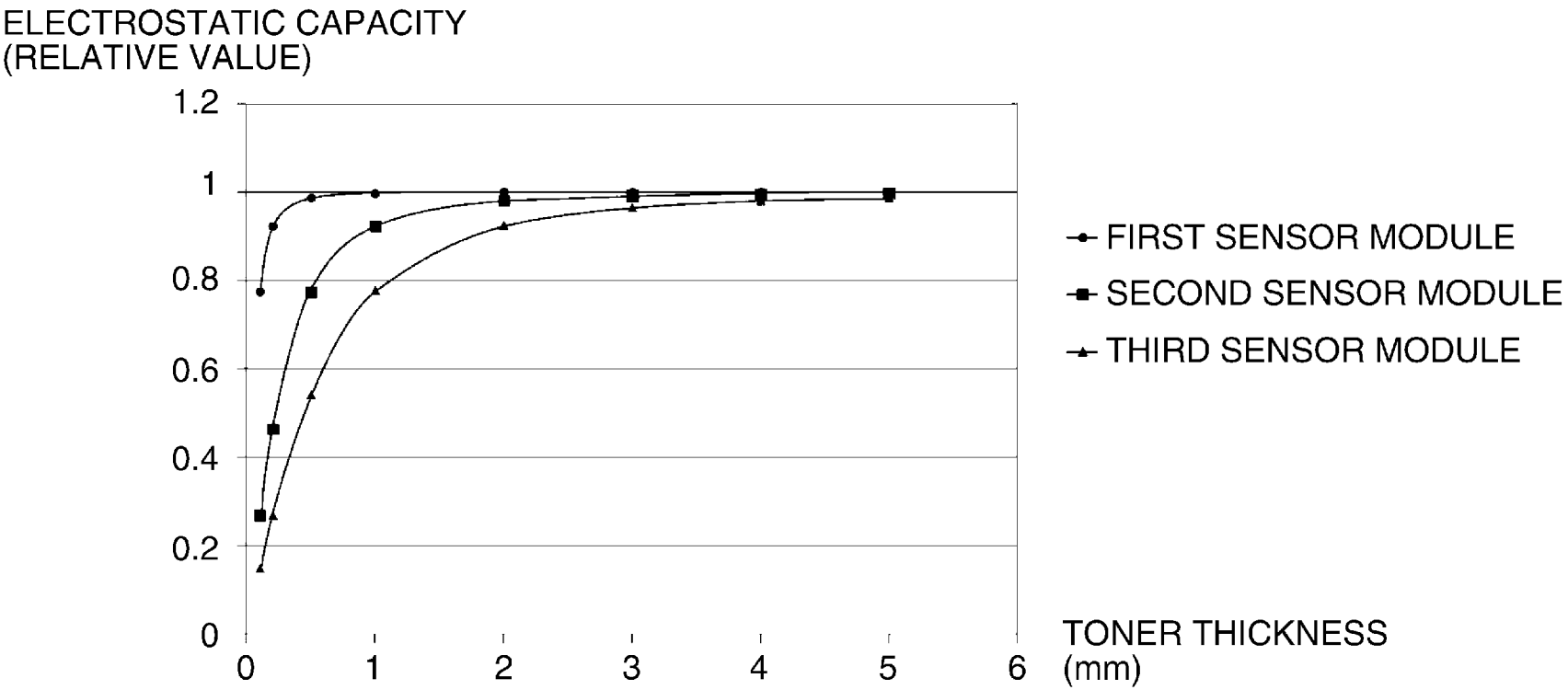
FIG. 8 is a graph showing capacitance laws of first, second, and third sensor modules shown in FIG. 5.

FIG. 8 is a graph showing the capacitance laws of the first, second, and third sensor modules 510, 511, and 512. In this example, the line width W1 of the first sensor module 510 is 0.1 mm and the conductor spacing D1 thereof is 0.1 mm. The line width W2 of the second sensor module 511 is 0.5 mm and the conductor spacing D2 thereof is 0.5 mm. The line width W3 of the third sensor module 512 is 1.0 mm and the conductor spacing D3 thereof is 1.0 mm.

Curves corresponding to the first sensor module 510, the second sensor module 511, and the third sensor module 512 shown in FIG. 8 indicate the values that are obtained by normalizing the variations of the electrostatic capacities due to the variation of toner thickness (the values after subtracting the values C10, C20, and C30 in the case of zero toner thickness) by the electrostatic capacities in the case of infinite toner thickness. That is, the electrostatic capacity indicated by the vertical axis in FIG. 8 is a relative value with respect to the case of infinite toner thickness. As shown in FIG. 8, the first sensor module 510, the second sensor module 511, and the third sensor module 512 show different capacitance laws to the variation of toner thickness. Accordingly, the toner thickness is presumed using the ratio of the electrostatic capacities of the first sensor module 510, the second sensor module 511, and the third sensor module 512 in this embodiment.

Figure 9:
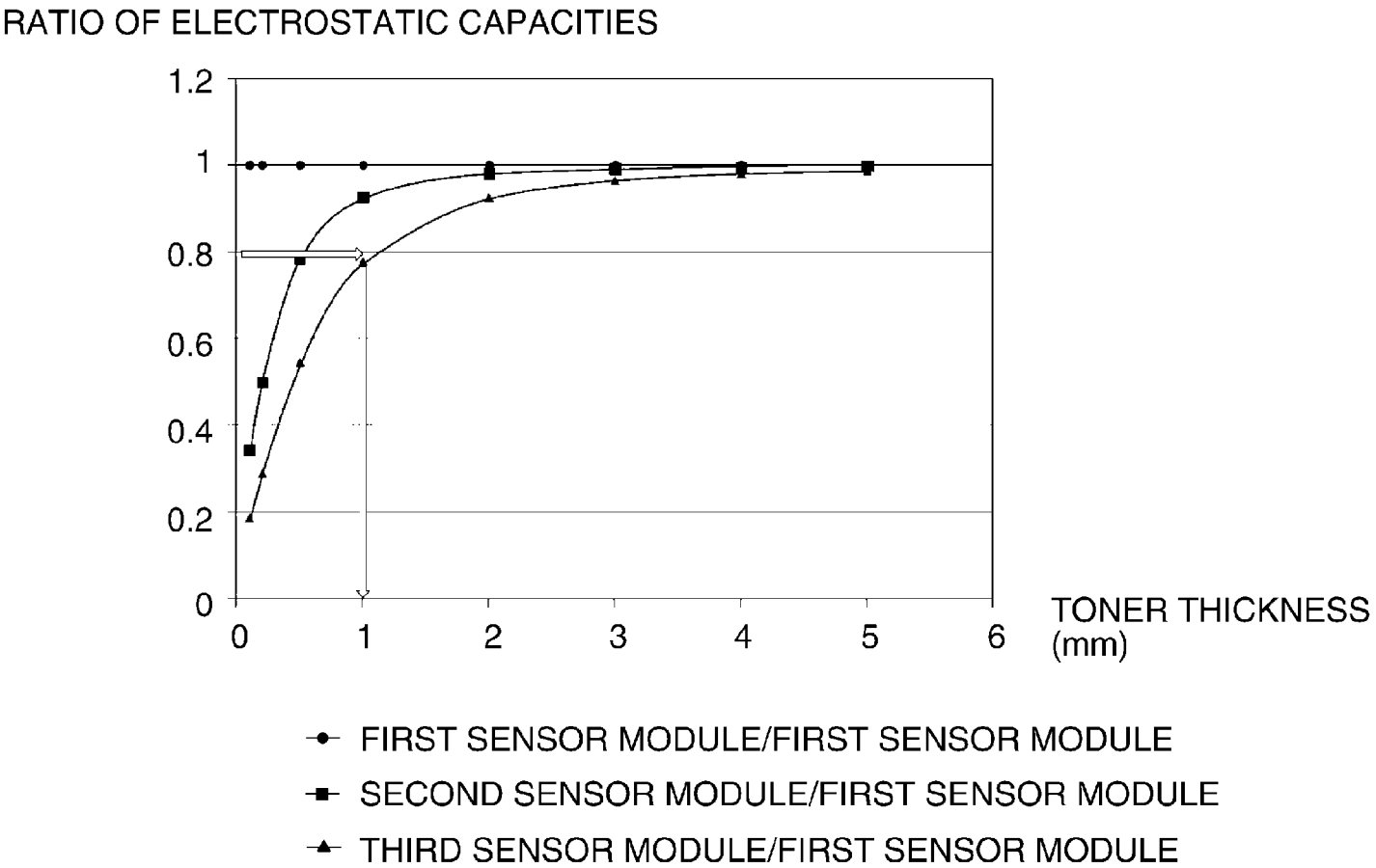
FIG. 9 is a graph showing the ratios of the capacitance laws of the second and third sensor modules to that of the first sensor module shown in FIG. 5.

FIG. 9 is a view showing the ratio of the capacitance laws of the second sensor module 511 and the third sensor module 512 to the capacitance law of the first sensor module 510, and shows the way of thinking of toner-thickness presumption typically. When the ratio of the electrostatic capacities (relative values) of the third sensor module 512 and the first sensor module 510 is 0.8, the toner thickness can be presumed as about 1 mm in view of FIG. 9. Similarly, the toner thickness can be presumed based on the ratio of the electrostatic capacities (relative values) of the second sensor module 511 and the first sensor module 510. The toner thickness can be detected more correctly by comparing the two estimation values acquired in this way. Details thereof will be described later with reference to FIG. 12.

Figure 10:
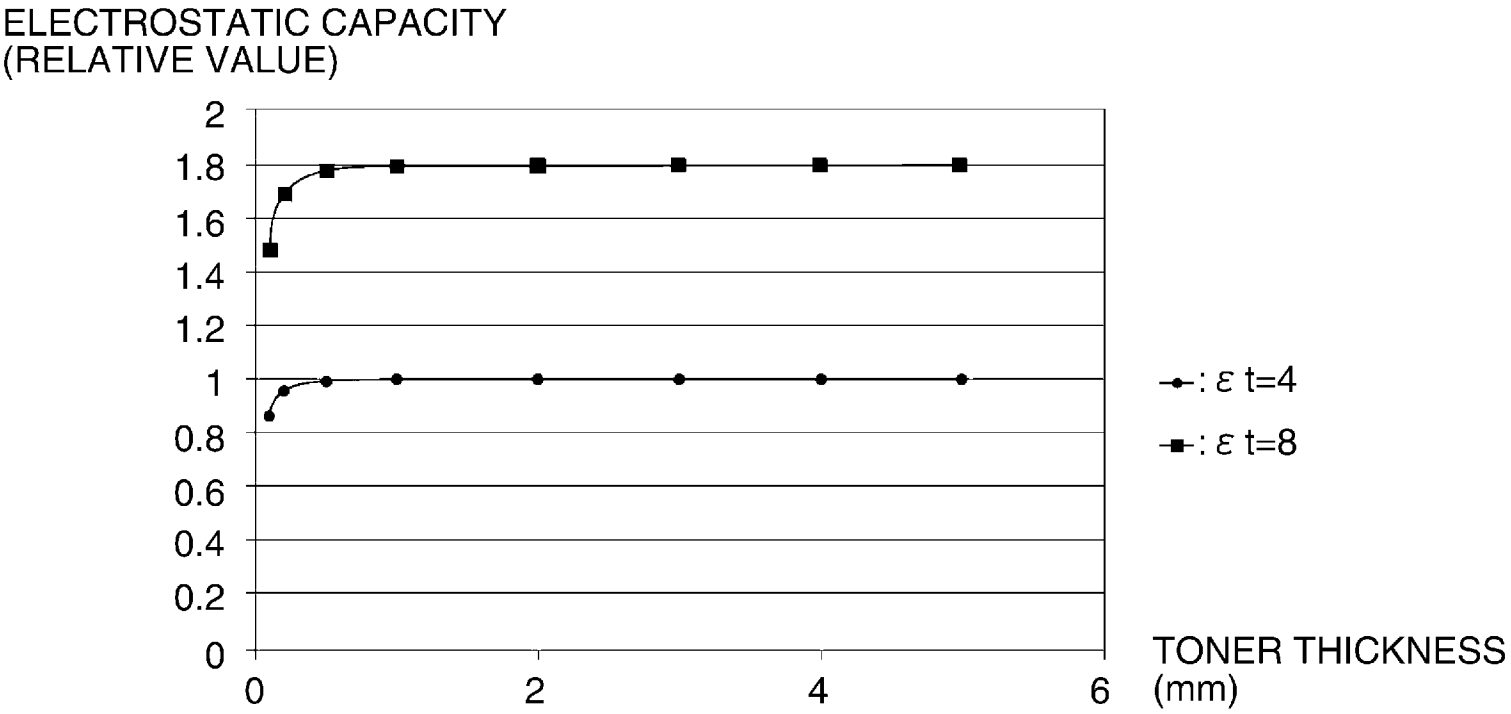
FIG. 10 is a graph showing electrostatic capacity changes of the first sensor module shown in FIG. 5 to the toner thickness for toner layers with different specific inductive capacities $\in t$.

Moreover, the electrostatic capacities of the first sensor module 510, the second sensor module 511, and the third sensor module 512 vary also depending on the specific inductive capacity $\in t$ of the toner layer 509. When the image forming apparatus 1 is in a working state, the temperature around the apparatus and moisture environment vary. Particularly, the variation of moisture content of toner due to the variation of environmental moisture changes the specific inductive capacity $\in t$ sharply. FIG. 10 is a graph showing variations of the electrostatic capacity of the first sensor module 510 that are normalized by the toner thickness like FIG. 8 for the toner layers 509 of which the specific inductive capacities $\in t$ are equal to "4" and "8". It is shown that the electrostatic capacity of the first sensor module 510 differs greatly when the specific inductive capacity $\in t$ of the toner layer 509 differs.

Figure 11:
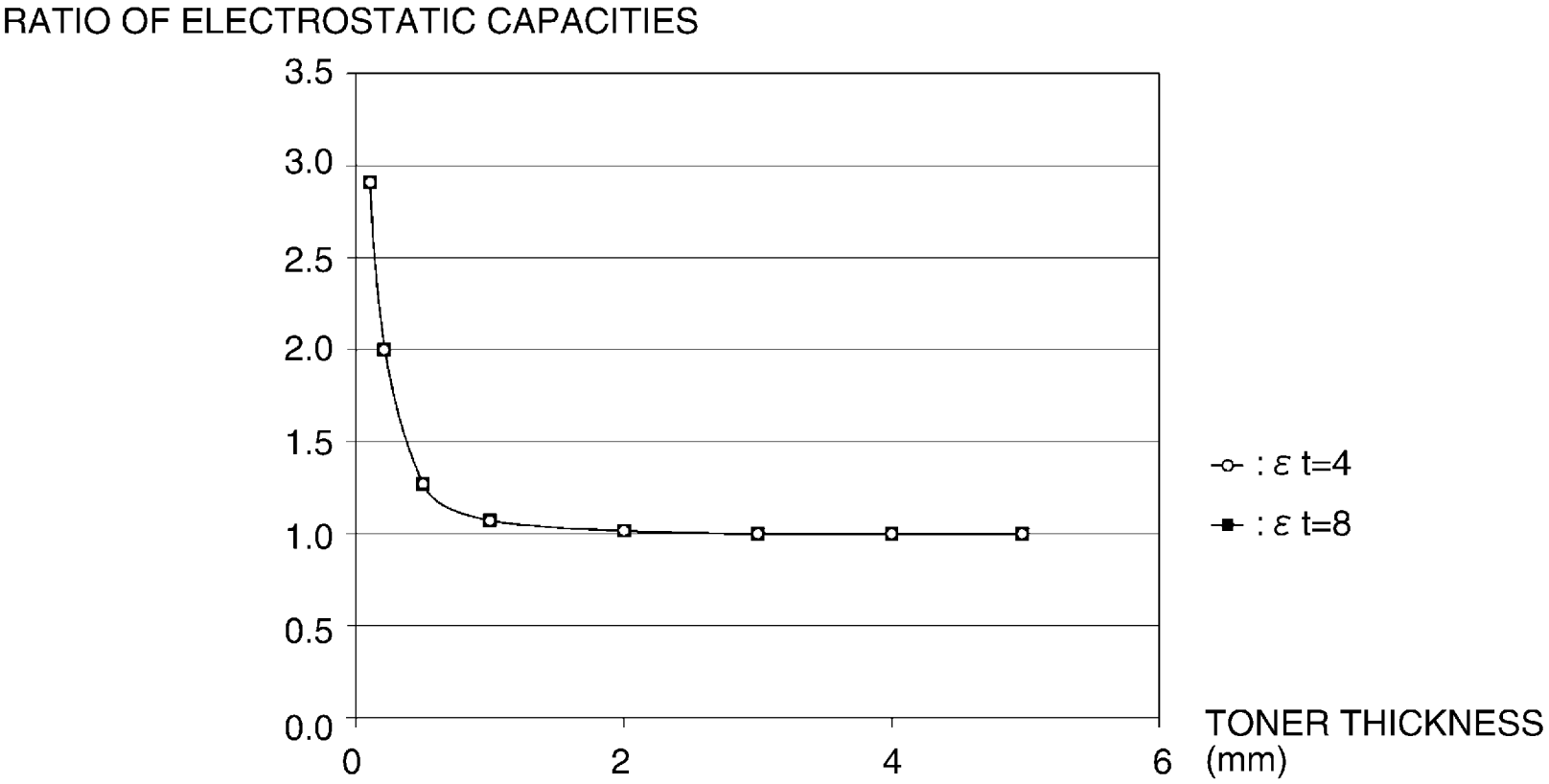
FIG. 11 is a graph showing a ratio between the electrostatic capacities of the first and second sensor modules shown in FIG. 5 for the toner layers with different specific inductive capacities $\in t$.

FIG. 11 is a graph showing a ratio between the electrostatic capacities of the first and second sensor modules 510 and 511 for the toner layers 509 of which the specific inductive capacities $\in t$ are equal to "4" and "8". Even if the specific inductive capacity $\in t$ of the toner layer 509 varies, the ratio between the electrostatic capacities of the first and second sensor modules 510 and 511 does not vary, and two curves corresponding to the cases where the specific inductive capacities $\in t$ are "4" and "8" overlap.

Since the moisture content of toner gently follows the variation of environmental moisture, the moisture content of the toner layer presumed based on the environmental moisture includes an error with respect to the actual moisture content, and it is difficult to lessen this error with the above-mentioned configuration of JP 2002-132038A. On the other hand, when the toner sensor that includes a plurality of sensor modules of which electrostatic capacities are different to the same toner thickness is used like this embodiment, the remaining toner amount can be detected with a reduced detection error because the detection is less subject to the variation of the specific inductive capacity of toner due to environmental variation.

Figure 12:
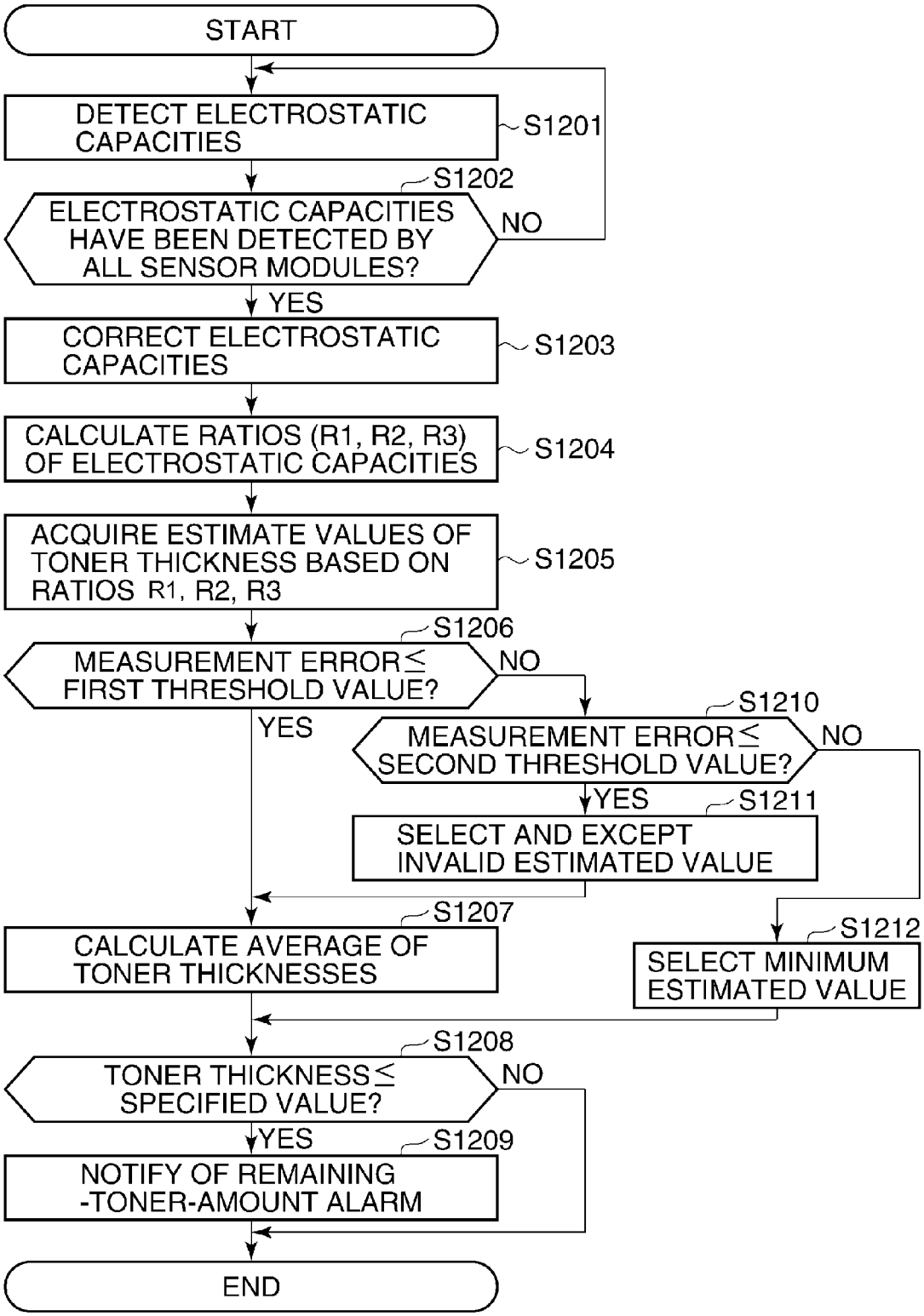
FIG. 12 is a flowchart showing a remaining toner amount detection process executed by the engine control unit shown in FIG. 4.

FIG. 12 is a flowchart showing a remaining toner amount detection process executed by the engine control unit 217. Each step is executed by running the predetermined program that the CPU 401 read from the ROM 403 and developed to the work area of the RAM 404. This remaining toner amount detection process is performed at definite time interval or predetermined timing (for example, when the power of the image forming apparatus 1 is turned ON and when a maintenance work is performed).

First, the electrostatic capacities of the first sensor module 510, the second sensor module 511, and the third sensor module 512 with which the toner sensor 304 is provided are detected (step S1201 (an electrostatic capacity detection step)). Then, the CPU 401 determines whether all the electrostatic capacities of the first sensor module 510, the second sensor module 511, and the third sensor module 512 have been detected (step S1202). After the detection of electrostatic capacities is completed (YES in the step S1202), the detected electrostatic capacities are corrected according to a compensation table based on the temperature measured by the temperature sensor 409, and also the standard electrostatic capacities (C10, C20, C30) are subtracted from the corrected electrostatic capacities (step S1203 (a standard electrostatic capacity subtraction step)). It should be noted that the compensation table and the standard electrostatic capacities are beforehand stored in the nonvolatile memory 402 (a first storage unit).

If the three electrostatic capacities acquired in the step S1203 shall be C1, C2, and C3, three ratios R1, R2, and R3 will be calculated according to the following formula 5 (step S1204 (an electrostatic capacity ratio calculation step)).

$$R1=C2/C1,\ R2=C3/C1,\ \text{and}\ R3=C3/C2 \qquad \text{[Formula 5]}$$

Next, the toner thickness is detected by checking the ratios R1, R2, and R3 against a conversion table that is stored beforehand in the ROM 403 (a second storage unit) (step S1205 (a toner thickness detection step)). It should be noted that the conversion table is generated by taking the ratios of the capacitance laws of the first sensor module 510, the second sensor module 511, and the third sensor module 512 as described with reference to FIG. 9. In this embodiment, the toner thickness detected in the step S1205 is not a final toner thickness. Accordingly, the toner thickness acquired in the step S1205 is hereafter referred to as an "estimated value".

Next, the CPU 401 determines whether the maximum difference (referred to as a "measurement error", hereafter) among the three estimated values acquired in the step S1205 is below a first threshold value defined beforehand (step S1206). When the measurement error is below the first threshold value (YES in the step S1206), the process proceeds to step S1207. When the measurement error is larger than the first threshold value (NO in the step S1206), the CPU 401 determines whether the measurement error is below a second threshold value defined beforehand (step S1210).

When the measurement error is below the second threshold value (YES in the step S1210), the CPU 401 determines an estimated value that is farthest from the average of the three estimated values as an invalid estimated value, excepts this invalid estimated value (step S1211), and proceeds with the process to the step S1207. When the measurement error is larger than the second threshold value (NO in the step S1210), the CPU 401 selects the smallest estimated value among the three estimated values as a final toner thickness (step S1212), and proceeds with the process to step S1208.

In the step S1207, the CPU 401 calculates the average of the three estimated values presumed in the step S1205 or the average of the two estimated values selected in the step S1211, and determines the average as the final toner thickness. Next, the CPU 401 determines whether the final toner thickness determined in the step S1207 or the step S1212 is below a specified value (step S1208). When the final toner thickness is below the specified value (YES in the step S1208), the CPU 401 determines that the remaining toner amount is little, and notifies the controller 216 of a remaining-toner-amount alarm (step S1209). Then, the remaining toner amount detection process finishes.

When receiving the notice in the step S1209, the controller sends a notice to a user by displaying a remaining-toner-amount alarm message through the operation unit 5 or by sounding alarm sound from a loudspeaker in order to urge the user to supply toner. At the same time, the operation of the entire image forming apparatus 1 is restricted or prohibited if needed.

In the first embodiment, the toner sensor 304 is configured by forming the electrodes of different line widths at the different conductor spacings on the same surface of the substrate 507 so that the first sensor module 510, the second sensor module 511, and the third sensor module 512 have different sensitivities to the thickness of the toner layer 509, respectively. On the other hand, in a second embodiment, two sensor modules are arranged by forming two pairs of electrodes of the same line width at the same conductor spacing so that the sensor modules show different electrostatic capacities with respect to the toner layer 509.

Figure 13A:
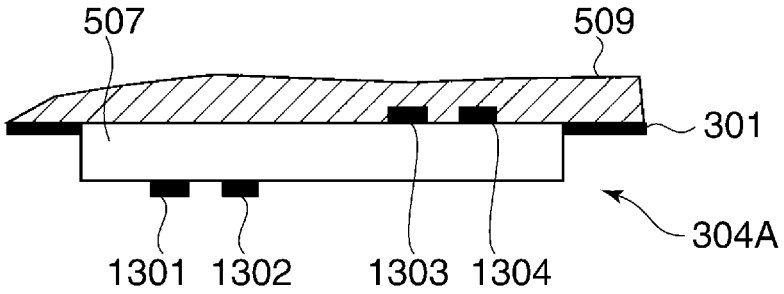
FIG. 13A and FIG. 13B are sectional views showing first and second examples of other configurations of the toner sensor with which the image forming apparatus according to the embodiment of the present invention is provided.
Figure 13B:
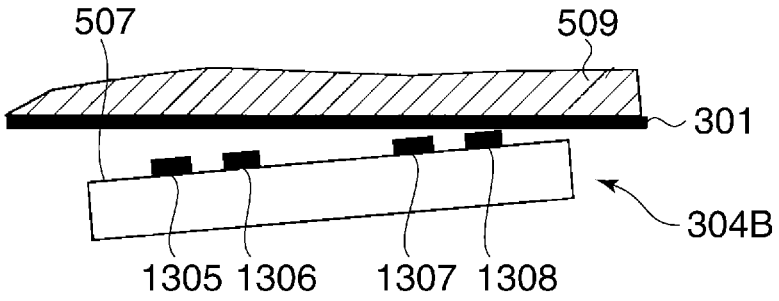

FIG. 13A is a sectional view showing a first example of another configuration of the toner sensor 304. FIG. 13B is a sectional view showing a second example of another configuration of the toner sensor 304.

The toner sensor 304A shown in FIG. 13A is configured by arranging one sensor module that consists of a pair of electrodes 1301 and 1302 on one surface of the substrate 507 and by arranging the other sensor module that consists of a pair of electrodes 1303 and 1304 on the other surface of the substrate 507. The electrodes 1301, 1302, 1303, and 1304 have the same line width, and the conductor spacing between the electrodes 1301 and 1302 is identical to the conductor spacing between the electrodes 1303 and 1304. Since the two sensor modules have different distances to the toner layer 509 (the distance to a toner detection face) by the thickness of the substrate 507, they show different electrostatic capacities with respect to the toner thickness. Accordingly, the second embodiment can determine the toner thickness (remaining toner amount) in the same manner as the first embodiment.

On the other hand, the toner sensor 304B shown in FIG. 13B is configured so that the substrate 507 is attached with inclination to the toner detection face of the buffer unit 301. Two sensor modules that consist of a pair of electrodes 1305 and 1306, and a pair of electrodes 1307 and 1308 with the same width and the same conductor spacing are arranged on the same side of the substrate 507. However, since the two sensor modules have different distances to the toner layer 509, they show different electrostatic capacities. Accordingly, the third embodiment can determine the toner thickness (remaining toner amount) in the same manner as the first embodiment.

It should be noted that only one ratio is acquired as the ratio of the electrostatic capacities of the sensor modules when the toner sensor 304A or 304B that includes two sensor modules is used. Accordingly, the thickness of the toner layer 509 will be determined by checking the calculated ratio of the electrostatic capacities against the conversion table in this case, and the comparisons with the first threshold value and the second threshold value that are required in the first embodiment are unnecessary.

Although the embodiments of the invention have been described, the present invention is not limited to the above-mentioned embodiments, the present invention includes various modifications as long as the concept of the invention is not deviated. The embodiments mentioned above show examples of the present invention, and it is possible to combine the embodiments suitably.

For example, although the above-mentioned embodiments described the configuration for detecting the remaining toner amount in the buffer unit 301, the toner amount in other units, such as a toner bottle and a recovery toner container, can be detected similarly. Moreover, although the above-mentioned embodiments described the configuration for detecting the amount of toner that is powder ink, the quantity of liquid ink etc. can be detected by an equivalent configuration.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-086478, filed on Apr. 5, 2012, which is hereby incorporated by reference herein in its entirety.

What is claimed is:

1. An image forming apparatus that forms an image with an electrophotographic system, comprising:

a container unit configured to store toner, a toner detection unit configured to have a plurality of sensor modules that are arranged at positions where the toner is stagnated in the container unit, and that show different electrostatic capacities with respect to the same toner thickness;

an electrostatic capacity detection unit configured to detect the electrostatic capacities of the sensor modules; and a determination unit configured to determine a remaining toner amount in the container unit based on the electrostatic capacities of the sensor modules that are detected by the electrostatic capacity detection unit, wherein the toner detection unit has at least three sensor modules, and wherein the determination unit calculates at least three ratios based on the electrostatic capacities of the at least three sensor modules that are detected by the electrostatic capacity detection unit, acquires at least three estimated values that presume the remaining toner amount in the container unit based on the at least three calculated ratios, and determines the remaining toner amount based on an average of the estimated values when the maximum difference among these estimated values is below a first threshold value.

2. The image forming apparatus according to claim 1, further comprising:

a first storage unit configured to store a conversion table that defines a relation between a ratio of electrostatic capacities of the sensor modules and toner thickness, wherein the determination unit acquires the toner thickness by checking the ratio of the electrostatic capacities against the conversion table, and determines the remaining toner amount based on the acquired toner thickness.

3. The image forming apparatus according to claim 1, further comprising:

a second storage unit configured to store standard electrostatic capacities for correcting the electrostatic capacities of the sensor modules individually, wherein the determination unit calculates the ratio of the electrostatic capacities using electrostatic capacities acquired by subtracting the corresponding standard electrostatic capacities from the electrostatic capacities of the sensor modules that are detected by the electrostatic capacity detection unit.

4. The image forming apparatus according to claim 3, wherein the standard electrostatic capacities are electrostatic capacities of the sensor modules when the toner does not exist.

5. The image forming apparatus according to claim 1, wherein each of the sensor modules consists of a pair of electrodes formed by arranging conductors of predetermined line width at predetermined spacing, and the sensor modules are different in at least one of the line width and the spacing so that the sensor modules show different electrostatic capacities with respect to the same toner thickness.

6. The image forming apparatus according to claim 1, wherein each of the sensor modules consists of a pair of electrodes formed by arranging conductors of predetermined line width at predetermined spacing, and the sensor modules are different in distance from the pair of electrodes to a toner detection face in the container unit so that the sensor modules show different electrostatic capacities with respect to the same toner thickness.

7. The image forming apparatus according to claim 1, further comprising:

a temperature sensor configured to detect internal temperature, wherein the determination unit corrects the electrostatic capacities of the sensor modules that are detected by the electrostatic capacity detection unit based on the temperature detected by the temperature sensor.

8. The image forming apparatus according to claim 1, wherein the determination unit determines, while excepting an invalid estimated value which is farthest from an average of the at least three estimated values the remaining toner amount based on an average of the estimated values other than the invalid estimated value when the maximum difference among these estimated values is more than the first threshold value and is below a second threshold value that is larger than the first threshold value.

9. The image forming apparatus according to claim 1, wherein the determination unit determines the remaining toner amount based on the minimum estimated value when the maximum difference among these estimated values is more than the first threshold value and is more than a second threshold value that is larger than the first threshold value.

10. An image forming apparatus comprising:

a container unit configured to store toner;

an image forming unit configured to form an image using the toner stored in the container unit;

a first output unit, having a first electrode and a second electrode, configured to output a first signal based on a first electrostatic capacity between the first electrode and the second electrode, wherein the first electrostatic capacity changes depending on an amount of the toner stored in the container unit;

a second output unit, having a third electrode and a fourth electrode, configured to output a second signal based on a second electrostatic capacity between the third electrode and the fourth electrode, wherein the second electrostatic capacity changes depending on the amount of the toner stored in the container unit, and wherein the third electrode and the fourth electrode are respectively wider than the first electrode and the second electrode;

a calculation unit configured to calculate a first ratio between the first signal and the second signal; and a determination unit configured to determine the amount of the toner stored in the container unit based on the first ratio calculated by the calculation unit.

11. The image forming apparatus according to claim 10, wherein the calculation unit calculates the first ratio by dividing the second signal by the first signal.

12. The image forming apparatus according to claim 10, further comprising a third output unit, having a fifth electrode and a sixth electrode, configured to output a third signal based on a third electrostatic capacity between the fifth electrode and the sixth electrode, wherein the third electrostatic capacity changes depending on the amount of the toner stored in the container unit, and wherein the fifth electrode and the sixth electrode are respectively wider than the third electrode and the fourth electrode, wherein the calculation unit further calculates a second ratio between the first signal and the third signal, and the determination unit determines the toner amount in the container unit based on the first ratio and the second ratio.

13. The image forming apparatus according to claim 12, wherein the calculation unit calculates the first ratio by dividing the second signal by the first signal, calculates the second ratio by dividing the third signal by the first signal, and calculates a third ratio by dividing the third signal by the second signal, and the determination unit determines the toner amount in the container unit based on the first ratio, the second ratio, and the third ratio.

14. The image forming apparatus according to claim 10, wherein the determination unit has a conversion unit configured to convert a result of the calculation of the calculation unit based on a conversion table, and determines the toner amount in the container unit based on the result of the calculation converted by the conversion unit.

15. The image forming apparatus according to claim 10, wherein the first electrode and the second electrode are on a single plane, and the third electrode and the fourth electrode are on a single plane.

16. An image forming apparatus comprising:

a container unit configured to store toner;

an image forming unit configured to form an image using the toner stored in the container unit;

a first output unit, having a first electrode and a second electrode, configured to output a first signal based on a first electrostatic capacity between the first electrode and the second electrode, wherein the first electrostatic capacity changes depending on an amount of the toner stored in the container unit;

a second output unit, having a third electrode and a fourth electrode, configured to output a second signal based on a second electrostatic capacity between the third electrode and the fourth electrode, wherein the second electrostatic capacity changes depending on the amount of the toner stored in the container unit, and wherein an interval between the third electrode and the fourth electrode is larger than an interval between the first electrode and the second electrode;

a calculation unit configured to calculate a first ratio between the first signal and the second signal; and a determination unit configured to determine the amount of the toner stored in the container unit based on the first ratio calculated by the calculation unit.

17. The image forming apparatus according to claim 16, wherein the calculation unit calculates the first ratio by dividing the second signal by the first signal.

18. The image forming apparatus according to claim 16, further comprising a third output unit, having a fifth electrode and a sixth electrode, configured to output a third signal based on a third electrostatic capacity between the fifth electrode and the sixth electrode, wherein the third electrostatic capacity changes depending on the amount of the toner stored in the container unit, and wherein an interval between the fifth electrode and the sixth electrode is larger than the interval between the third electrode and the fourth electrode, wherein the calculation unit further calculates a second ratio between the first signal and the third signal, and the determination unit further the toner amount in the container unit based on the first ratio and the second ratio.

19. The image forming apparatus according to claim 18, wherein the calculation unit calculates the first ratio by dividing the second signal by the first signal, calculates the second ratio by dividing the third signal by the first signal, and calculates a third ratio by dividing the third signal by the second signal, and the determination unit determines the toner amount in the container unit based on the first ratio, the second ratio, and the third ratio.

20. The image forming apparatus according to claim 16, wherein the determination unit has a conversion unit configured to convert a result of the calculation of the calculation unit based on a conversion table, and determines the toner amount in the container unit based on the result of the calculation converted by the conversion unit.

21. The image forming apparatus according to claim 16, wherein the first electrode and the second electrode are on a single plane, and the third electrode and the fourth electrode are on a single plane.

* * * * *